US005542766A

United States Patent [19]

Cadwallader

[11] Patent Number: 5,542,766

[45] Date of Patent: Aug. 6, 1996

[54] WATERPROOF CLOSURE SEAL FOR BAGS, CLOTHING AND OTHER USES

[76] Inventor: Richard J. Cadwallader, 6237 Yorktown Dr., Orlando, Fla. 32807

[21] Appl. No.: 544,607

[22] Filed: Oct. 18, 1995

Related U.S. Application Data

[63] Continuation of Ser. No. 228,264, Apr. 15, 1994, abandoned.

[51] Int. Cl.[6] ..... B65D 33/25

[52] U.S. Cl. ..... 383/63; 383/68; 24/30.5 R

[58] Field of Search ..... 383/63, 68, 69; 24/30.5 R, 460, 462

[56] References Cited

U.S. PATENT DOCUMENTS

| | | | |
|---|---|---|---|
| 2,606,587 | 8/1952 | Porter | 383/68 |
| 3,181,583 | 5/1965 | Lingenfelter | 383/63 X |
| 3,280,870 | 10/1966 | Bundy | 383/63 X |
| 3,344,977 | 10/1967 | Kamins et al. . | |
| 3,395,788 | 8/1968 | Gill . | |
| 3,402,749 | 9/1968 | Kinzler . | |
| 3,426,814 | 2/1969 | Bundy | 383/634 X |
| 3,509,927 | 10/1967 | Hasty et al. . | |
| 4,006,764 | 2/1977 | Yamamoto et al. . | |
| 4,479,244 | 10/1984 | Ausnit . | |
| 4,615,045 | 9/1986 | Siegel . | |
| 4,892,414 | 1/1990 | Ausnit | 383/63 |
| 5,172,430 | 12/1992 | Lerma-Solis | 2/400 |

FOREIGN PATENT DOCUMENTS

| | | | |
|---|---|---|---|
| 1140723 | 8/1957 | France | 383/63 |
| 1476709 | 4/1967 | France . | |
| 8701097 | 2/1987 | WIPO | 383/63 |
| 9203353 | 3/1992 | WIPO | 24/30.5 R |

*Primary Examiner*—Jes F. Pascua
*Attorney, Agent, or Firm*—Edward M. Livingston, Esq.

[57] ABSTRACT

A waterproof closure seal (20, 22) for closing openings on bags, pockets and other items having two components, a male (2) and female (1) component. The male component (2) has a planar base (12) with a wide insert having indentations (10*a*, 10*b*) on each side which fits into a cavity (8) on the female component (1) when pressure is applied on the outside of both components (1, 2). The female component (1) has legs (7*a*,7*b*) on each side of the cavity (8) with hooks (6*a*, 6*b*) which fit into the indentations (11*a*, 11*b*) on each side of the male insert (3) to better grasp the insert. The female component (1) may have one or more ribs (14) extending from it which fit into matching grooves (15) on the male cavity (2) to form an even better seal. An elastomeric overlay (16) can be molded on the male insert (3) to better maintain the seal even in extreme temperature conditions. The male and female component may be attached to each other at one end and used to seal a bag, such as a potato chip bag, to preserve freshness. The components may be staggered at the unattached end for easier opening.

12 Claims, 2 Drawing Sheets

WATERPROOF CLOSURE SEAL FOR BAGS, CLOTHING AND OTHER USES

CROSS-REFERENCE TO RELATED APPLICATION

This is a continuation of application Ser. No. 08/228,264, filed Apr. 15, 1994—now abandoned.

BACKGROUND OF THE INVENTION

This invention relates to closure devices and more particularly a closure seal for securing the opening of bags, clothing and other items.

Currently, closure seals for plastic bags and other items are made of plastic and have one or more protruding ridges or ribs on one component which fits into a groove on the other component. Although such closure seals may provide some protection from water or the elements, such seals can usually be easily opened or water and/or air can easily intrude into the closed opening as the rib and groove are too narrow and are not strong enough to maintain the seal. Other non-plastic seals, such as hook and loop fastening material, some commonly sold under the Velcro name, have also been used for sealing openings. However, such fastening materials are not air-tight and not waterproof.

Thus, a need exists for a new, strong, waterproof and air-tight multiple use closure seal.

The prior patented art includes some closure seals, but none like the present invention. For instance, French Patent No. 1,476,709, issued Feb. 18, 1966, discloses a one-handed flexible bag with a plastic snap-lock type enclosure, but it has a different structure than the present invention. U.S. Pat. No. 4,479,244 by Ausnit, issued Oct. 23, 1984, shows another plastic bag with a snap-lock enclosure. Other pertinent U.S. Patents include U.S. Pat. No. 3,402,749 by Kinzler, issued Sep. 24, 1968; 4,615,045 by Siegel, 3,344,977, issued Sep. 30, 1986; 3,344,977 by Kamins, et al., issued Oct. 3, 1967; 3,509,927 by Hasty, et al., issued May 5, 1970; 3,395,788 by Gill, issued Aug. 6, 1968; and 4,006,764 by Yamamoto, et al., issued Feb. 8, 1977. All of the latter patents teach some type of closure seal, but all are different from the present invention.

Unlike the prior art, the present invention provides a closure seal with a strong, wide seal having multiple sealing points for preventing the intrusion of water, air or other elements as well as the leakage of internal contents being sealed within the container.

SUMMARY OF THE INVENTION

The primary object of the present invention is to provide a closure seal which securely and strongly closes the openings of bags, pockets or other items.

Another object of the present invention is to provide such a closure seal which is waterproof to keep moisture from intruding into the contents of the container on which the closure seal is used.

A further object of the present invention is to provide such a closure seal that prevents leakage of the contents of a sealed container on which the seal is used.

An even further object of the present invention is to provide such a closure seal which is air-tight and impervious to other elements outside the container.

Yet another object of the present invention is to provide such a closure seal which can be used to fasten one object to another.

An additional object of the present invention is to provide such a closure seal which is sufficiently flexible so it can be used in multiple uses which are subject to bending and other movement which occurs with bags, clothing and in other uses.

The present invention fulfills the above and other objects by providing an elongated enclosure seal which has male and female components. The male component has a generally planar base with flanges extending from each side of the base and an insert extending a pre-determined length from the base. The insert is wider at its outermost point so that it forms an indentation on both sides at the base. The female component also has a generally planar outer surface and an inner surface from which two legs extend to form a cavity between the legs. The size of the cavity is sufficient to hold the insert part of the male component. The legs on the female component have a hook on the innermost extension on the side facing the cavity so that the hooks fit into the indentations along each side of the male insert. The components form a seal when pressure is exerted on the outer sides of the components so that the insert on the male component fits into the cavity of the female component. The female component may contain one or more ribs extending outward on the cavity which fits into a matching groove in the male component which fits into the groove.

A soft elastomeric or soft rubber overlay may be molded on top of the male component so as to provide even a better seal in cases of extreme temperature conditions where the male or female component may expand or contract in response to such conditions. The closure seal may be utilized to seal the openings of bags, the pockets of clothing or other uses.

Other objects and advantages of this invention will become more readily apparent when the detailed description of the preferred embodiments is described in conjunction with drawings.

BRIEF DESCRIPTION OF THE DRAWINGS

The drawing figures used to illustrate the preferred embodiments of the invention are as follows.

DESCRIPTION OF THE REFERRED EMBODIMENTS

Figure 1:
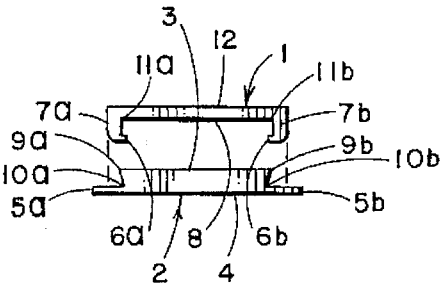
FIG. 1 is a end view of the closure seal with its components in an open or unsealed position.

With reference to the drawing figures, FIGS. 1–5 show various views of one embodiment of the closure seal. In FIG. 1 the two components of the closure seal are shown in an open or unsealed position. The female component 1 has a planar base 12 having two legs 7*a* and 7*b* of equal length extending from each side to form a cavity 8 between the legs 7*a* and 7*b*. The inside of the legs facing the cavity 8 is slanted to form two indentations 11*a* and 11*b* on the inside of the intersection between the base 12 and legs 7*a* and 7*b*. The inside end of the legs 7*a* and 7*b* also extends inwardly toward the cavity to form holding hooks 6*a* and 6*b*.

The male component 2 of the closure seal has a generally planar base 4 from which extends an insert 3. The insert 3 is a sized and shaped so that it fits into the cavity 8 on the female component 1. The sides 9*a* and 9*b* of the insert 3 are slanted to form indentations 10*a* and 10*b* at the intersection of the base and the insert and also holding points 9*a* and 9*b* at the top of the insert 3. The base 4 of the male component 2 extends beyond the sides of the insert 3 to form flanges 5*a* and 5*b* on each side. The purpose of the flanges 5*a* and 5*b* is to form a grasping portion so that a person can open the seal when it is closed.

Figure 2:
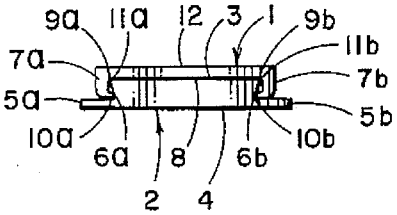
FIG. 2 is an end view of the closure seal with its components in a closed or sealed position.

In FIG. 2 the closure seal is shown in a sealed or closed position with the female component 1 and male component 2 fitted together by asserting pressure on the bases 12 and 4, respectively, of the components.

Figure 3:
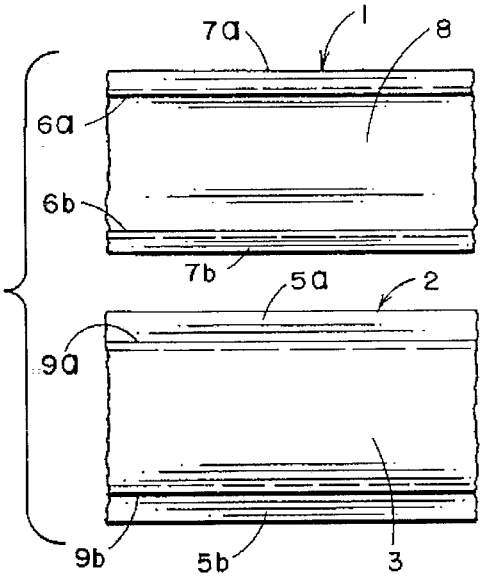
FIG. 3 is a top view of the inside of the male and female components of the closure seal.

FIG. 3 shows the inside of the female and male components, 1 and 2, respectively. The cavity 8 on the female component 1 has two hooks 6*a* and 6*b* on the legs 7*a* and 7*b*, respectively. The male component 2 has an insert 3 with the two holding points 9*a* and 9*b* extending therefrom with the two flanges 5*a* and 5*b* on each side thereof.

Figure 4:
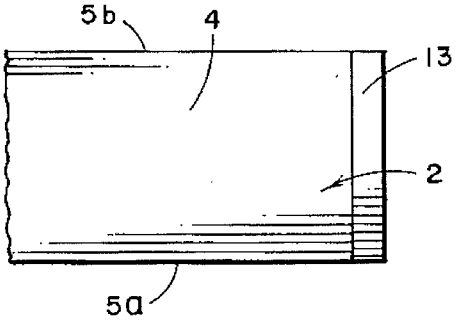
FIG. 4 is a partial top view of the closure seal from the male component side.

In FIG. 4 the closure seal is shown from the side of the male component 2 wherein both components are bonded together at the end 13 as it might be utilized if the closure seal is used on a bag. When the closure seal is used on a bag both ends of the elongated seal could both be bonded with the seal being openable between the ends.

Figure 5:
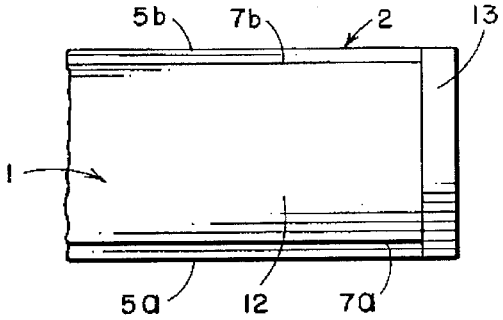
FIG. 5 is a partial top view of the closure seal from the female side.

FIG. 5 illustrates the closure seal bonded at the end 13 from the side of the female component 1. In this view the base 12 of the female component is shown with its legs 7*a* and 7*b*. Also, in this view the flanges 5*a* and 5*b* of the male component 2 can be seen extending beyond the sides of the female component 1.

Figure 6:
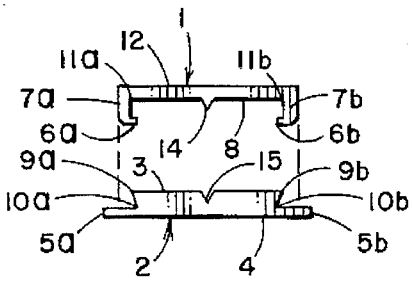
FIG. 6 is an end view of a second embodiment of the closure seal with the male and female components in an open or unsealed position.
Figure 7:
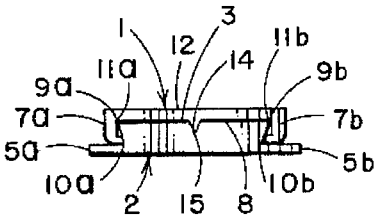
FIG. 7 is an end view of the closure seal of FIG. 6 in a closed or sealed position.
Figure 8:
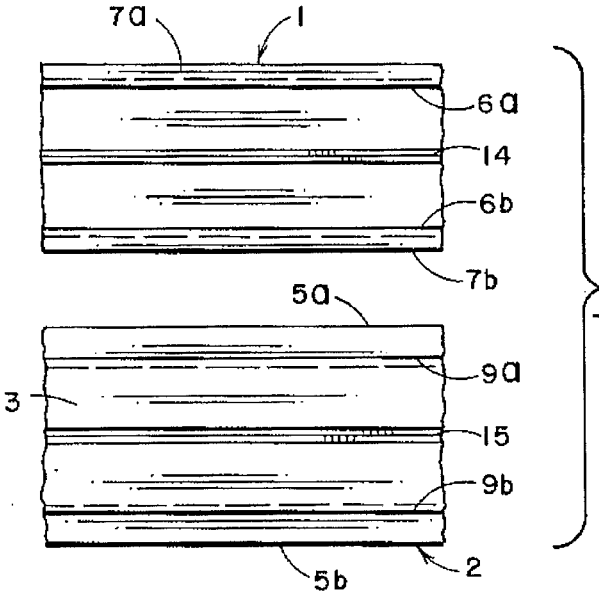
FIG. 8 is a top view of the inside of the male and female components of the closure seal of FIG. 6.

FIGS. 6, 7 and 8 illustrate a second embodiment of the invention. The only difference between this embodiment and the first embodiment illustrated in FIGS. 1–5 is that an additional sealing barrier for the seal. More specifically, in the female component 1 a rib or ridge 14 is contained in the cavity 8. The male component 2 contains a matching groove or cut 15 on its insert 3. Thus, when the two components are pressed together to form a seal, as shown in FIG. 7, the rib 14 fits into the groove 15 on the male component 2. The rib 14 and groove 15 provide an additional barrier to prevent the intrusion or extrusion of moisture, air or other items from inside or outside the container on which the closure seal is used. Although FIGS. 6 and 7 show the use of only one rib and groove, one or more ribs or grooves may be utilized to form even further barriers. The top view of the second embodiment in FIG. 8 shows the same components discussed hereinabove.

Figure 9:
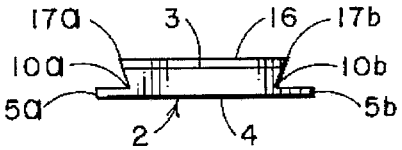
FIG. 9 is an end view of the male side of the closure seal of the first embodiment with an elastomeric overlay on the insert for further sealing.

In FIG. 9 the use of a soft elastomeric or rubberized material 16 is illustrated whereby it is molded on the insert 3 of the male component 2. The use of an elastomeric or rubberized material on top of the insert 3 may be important in extreme temperature conditions whereby the more rigid male and female components, 2 and 1, respectively, which are preferably made of a harder plastic than the overlay, are susceptible to expansion or contraction. In such cases the elastomeric overlay 16, which is compressible, fills the cavity 8 of the female component 1 in a better manner to prevent leakage under such conditions.

Figure 11:
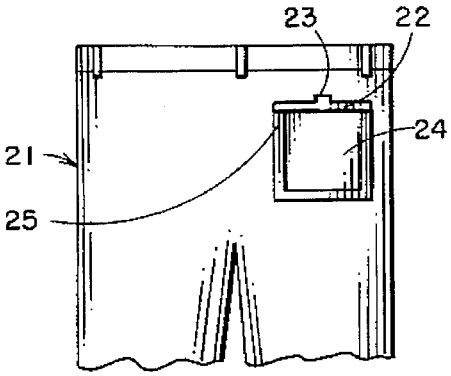
FIG. 11 is a front view of clothing using the closure seal for pockets.
Figure 10:
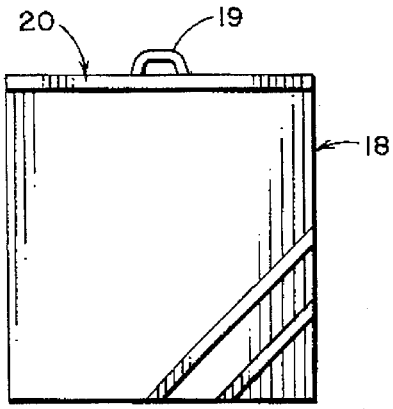
FIG. 10 is a side view of a bag using the closure seal.

Two applications of the seal are illustrated in FIGS. 10 and 11. In FIG. 10 the use of the closure seal 20 is shown for a bag 18. Most likely the bag 18 would be made of polystyrene and the male and female components would be molded on one side along the top opening of the bag 18. One or both of the components could contain a handle 19 molded to the top thereof. Merely by applying pressure to both sides of the bag along the base 12 of the female component 1 and base 4 of the male component 2 would cause the bag to seal in a waterproof and air-tight manner. The bag would be easily opened by pulling outward at the handles 19 if a handle is attached to each component, or at the flanges 5*a* or 5*b* on the male component 2.

The closure seal could also be utilized on clothing to seal pockets as illustrated in FIG. 11. For instance, on shorts 21 the closure seal 22 could be placed along the top of a pocket and have a small tab 23 connected to one of the components to open same. It is more likely the female component would be attached to the clothing itself with the male component attached to the outside of the pocket 24. Therefore, merely pressing the outside of the male component would seal the pocket 24 and pulling outward on the tab 23 would open it. To make sure the pocket is fully waterproof, the pocket could be permanently sealed in plastic 25 around the two sides and bottoms thereof.

Figure 12:
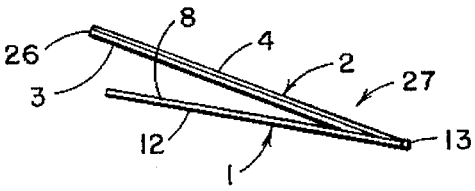
FIG. 12 is a top view showing the closure seal with its components attached at one end and one component longer than another for easier opening.

FIG. 12 shows embodiment of the closure seal 27 which is reusable for sealing bags, such as potato chip bags, to preserve freshness of a product. In this embodiment the male and female components of the seal, 2 and 1, respectively, are spread apart to fit around a bag. Either component, such as the male component 2 may be extended or staggered at 26 so when the components are attached, the seal can be easily opened by pushing on the longer component.

Figure 13:
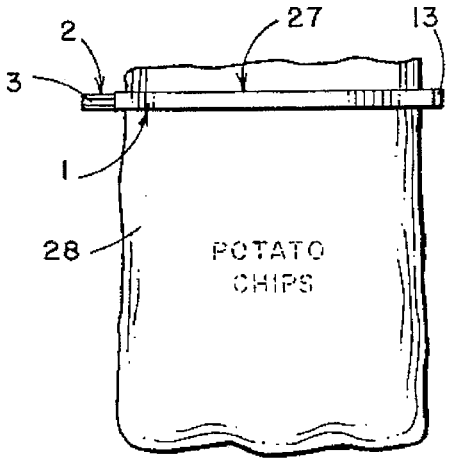
FIG. 13 is a side view showing the closure seal of FIG. 12 being used to seal a potato chip bag.

FIG. 13 illustrates the closure seal 27 of FIG. 12 in use on a potato chip bag 28. In such use the seal 27 is placed around the top of the bag 28 and the components 1 and 2 are pressed inward against each other by the fingers until the components snap together. This closures seal makes an airtight and waterproof seal of the bag to preserve freshness of the product.

The closure seal would more preferably be made of a rigid, but flexible material, such as some type of plastic or polymer. The closure seal would be attachable to any opening to which plastic could be molded.

Although a few embodiments of the enclosure seal have been described in detail above, all modifications and variations of the closure seal within the scope or equivalent of the claims are covered by this invention.

Having thus described my invention, I claim:

1. An elongated closure seal having two components comprising:

an elongated male component having a generally planar base, said base having two sides with flanges extending from each side of the base and an insert attached to and extending a predetermined length outward from the base, said insert having a planar top surface and two sides, the top surface being wider at an outermost extension then at the base so as to form an indentation along the bottom of each side of the insert; and an elongated female component having a generally planar base and two legs, each extending perpendicularly from an inner surface of the base to form a cavity between said legs, said cavity being of sufficient size to hold the insert on the male component, each of said legs further having a sharp hook at an outer most extension on a side facing the cavity, said horizontal inwardly-facing hooks fitting into the indentation along the bottom of each side of the insert on the male component when sufficient inward pressure is exerted on the bases of the male component and female component to mate the components.

2. The closure seal of claim 1 further comprising:

at least one rib extending outward from the cavity of the female component; and at least one groove in the planar top surface of the insert on the male component at a matching position to each rib on the female component so that each rib fits into a groove when the male and female components are mated.

3. The closure seal of claim 1 wherein the male and female components are of equal length and bonded together at each end to form an integral seal on any opening to which the seal is attached.

4. The closure seal of claim 2 wherein the male and female components are of equal length and bonded together at each end to form an integral seal on any opening to which the seal is attached.

5. The closure seal of claim 1 wherein the male component of the seal has an elastomeric overlay attached to the top surface of the insert to form a further barrier against moisture and other elements.

6. The closure seal of claim 2 wherein the male component of the seal has an elastomeric overlay attached to the top surface of the insert to form a further barrier against moisture and other elements.

7. The closure seal of claim 3 wherein the male component of the seal has an elastomeric overlay attached to the top surface of the insert to form another barrier against moisture and other elements.

8. The closure seal of claim 4 wherein the male component of the seal has an elastomeric overlay attached to the top surface of the insert to form another barrier against moisture and other elements.

9. The closure seal of claim 1, 2, 3, 4, 5, 6, 7 or 8 wherein the seal is used to secure an opening of a bag having a closed bottom and two sides, the male component being attached to one side of the bag at its opening with the insert facing inward and the female component attached to the other side of the opening with its cavity facing inward so that when pressure is exerted on an outer surface of each the components, the insert on the male component snaps into the cavity of the female component to form a seal.

10. The closure seal of claim 1, 2, 3, 4, 5, 6, 7, or 8 wherein the seal is used to secure the opening of a pocket on clothing, said pocket having an outside surface, a closed bottom and two closed sides with a top opening, with one component attached at the top of the pocket on the clothing and the other component on the clothing to which the pocket is attached so that when pressure is exerted from outside near the top of the pocket the components mate to seal the pocket opening.

11. The closure seal of claim 1 wherein the male and female components are bonded together at one end to form a removable and reusable seal for a bag.

12. The closure seal of claim 11 wherein one of the components is longer than the other at an end opposite the end which is bonded so the seal can be opened more easily.

* * * * *